US005687613A

United States Patent [19]

Swedberg

[11] Patent Number: 5,687,613

[45] Date of Patent: Nov. 18, 1997

[54] CRIMP CONNECTOR APPLICATOR

[75] Inventor: Benjamin D. Swedberg, Sycamore, Ill.

[73] Assignee: Ideal Industries, Inc., Sycamore, Ill.

[21] Appl. No.: 600,704

[22] Filed: Feb. 13, 1996

[51] Int. Cl.[6] ..... H01R 43/055

[52] U.S. Cl. ..... 72/424; 29/753; 29/818

[58] Field of Search ..... 72/409.06, 409.04, 72/424; 29/753, 751, 816, 818, 859, 861

[56] References Cited

U.S. PATENT DOCUMENTS

| | | | |
|---|---|---|---|
| 3,016,774 | 1/1962 | Minobe . | |
| 3,068,485 | 12/1962 | Lingle et al. . | |
| 3,094,349 | 6/1963 | Schwalm . | |
| 3,182,389 | 5/1965 | Phillips . | |
| 3,460,230 | 8/1969 | Moulin . | |
| 3,517,856 | 6/1970 | Ginther . | |
| 3,599,472 | 8/1971 | Koletsos et al. | 72/424 |
| 3,653,117 | 4/1972 | Wolfberg et al. | 29/243.56 |
| 3,733,883 | 5/1973 | Kaczmarek | 72/402 |
| 3,988,102 | 10/1976 | Bakermans et al. . | |
| 4,005,519 | 2/1977 | Di Maio | 29/818 |
| 4,027,370 | 6/1977 | Bachar | 29/818 |
| 4,114,253 | 9/1978 | Loomis et al. | 29/753 |
| 4,236,302 | 12/1980 | Kuehling | 29/753 |
| 4,348,806 | 9/1982 | Eves et al. | 29/753 |
| 4,489,589 | 12/1984 | Kirsinas | 72/424 |
| 4,991,289 | 2/1991 | French | 29/753 |
| 5,054,191 | 10/1991 | Schule | 29/863 |
| 5,074,033 | 12/1991 | Dassance et al. | 29/753 |
| 5,143,216 | 9/1992 | Aurtoi | 29/818 |

*Primary Examiner*—Daniel C. Crane

*Attorney, Agent, or Firm*—Dorn, McEachran, Jambor & Keating

[57] ABSTRACT

An applicator for installing pre-insulated crimp connectors on the bare ends of electrical wires has a body with a straight-through passageway which permits loading a single connector in the applicator with a pulse of pressurized air. The connector is propelled by the air pulse from a supply station through a flexible hose into and almost all the way through the applicator. A flexible retainer prevents the connector from exiting the applicator under the influence of the air pulse. After the connector is stopped by the retainer a pair of indentors close on the connector and hold it in a ready position, waiting for a user to insert the wires to be connected and issue a command to crimp the connector. Upon receipt of such command the indentors apply a crimping force to the connector and advance it past the retainer.

9 Claims, 4 Drawing Sheets

10
12
14
16
18
20
22
24
26
28
30
32
33
34
36
38
40
42
44
46
48
50
52
54
10a
10b
10c
10d
10e

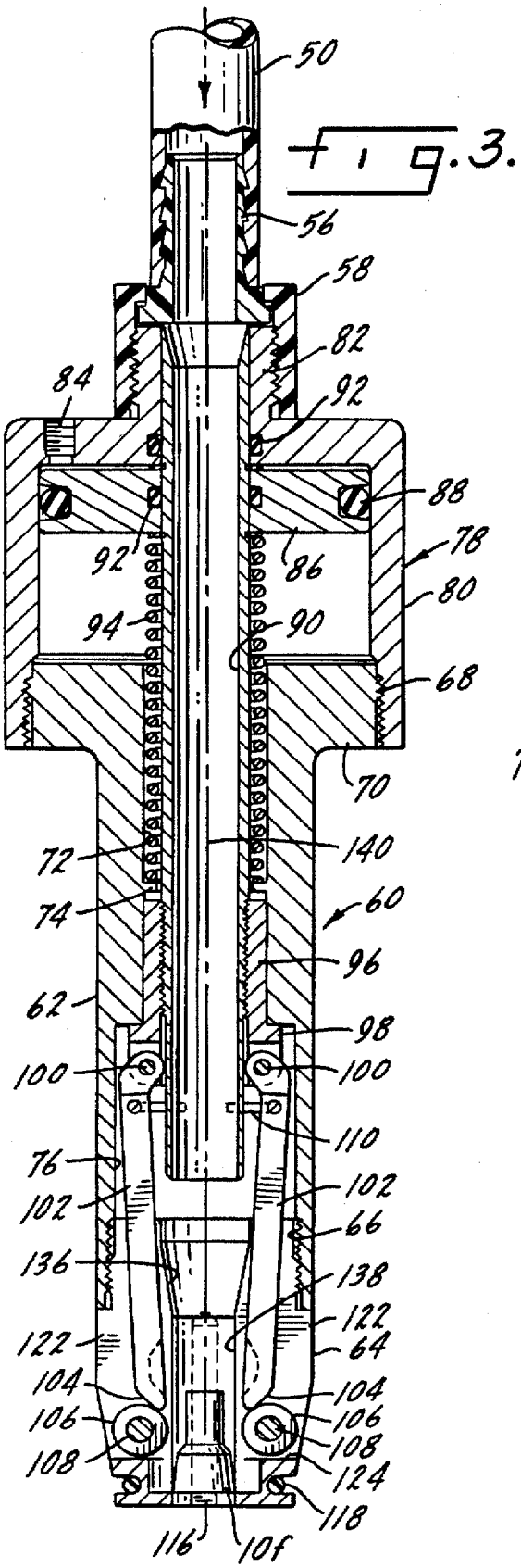
Fig. 3.
Fig. 5.
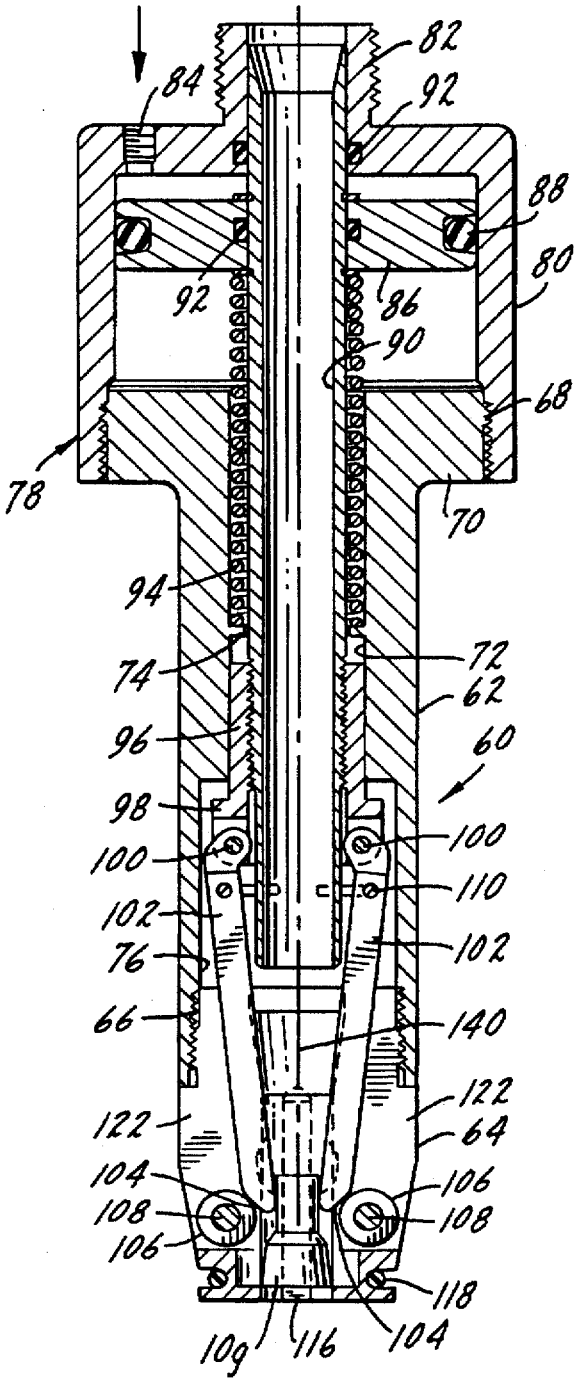

Fig. 9.
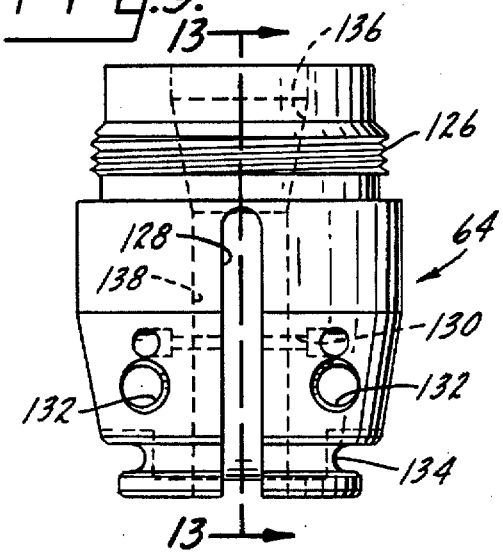
Fig. 10.
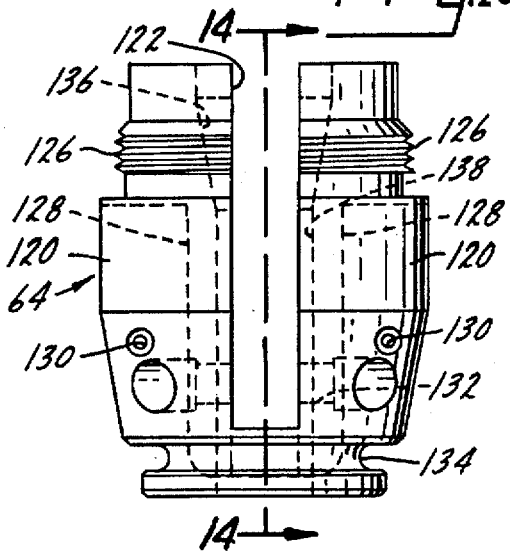
Fig. 11.
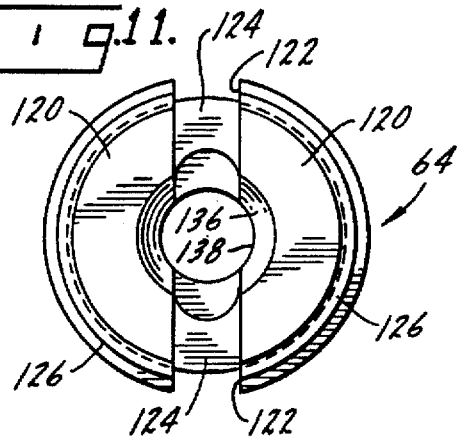
Fig. 12.
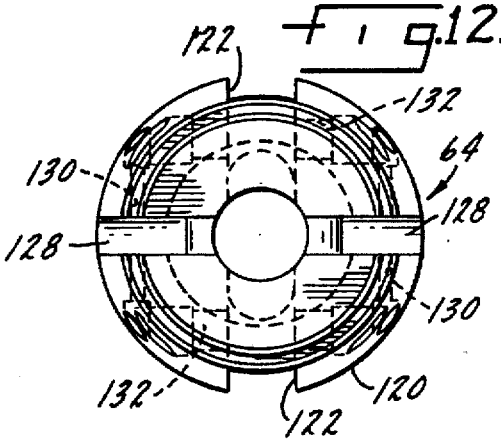
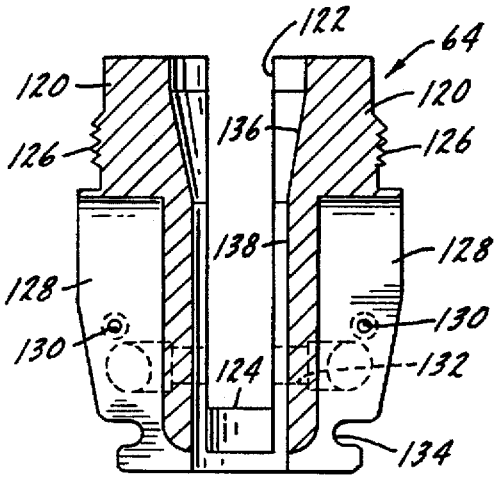
Fig. 13.
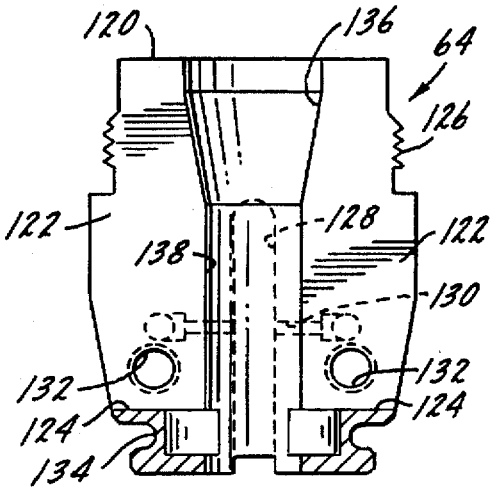
Fig. 14.

CRIMP CONNECTOR APPLICATOR

SUMMARY OF THE INVENTION

Pre-insulated crimp connectors, sometimes also known as pigtail connectors, comprise a metallic ferrule surrounded by a plastic housing or cover. Both the ferrule and housing are crimped about the exposed conductors of two or more wires to mechanically and electrically connect the wires. Crimp connectors can be installed in small numbers by suitable hand tools in the nature of pliers. But in production operations hand tools will not suffice so automated installation machines are used. One such machine is shown in U.S. Pat. No. 4,489,589.

Automated crimp connector installation machines include a supply unit that provides connectors to a tool that crimps the connectors onto the ends of wires. The crimping force is supplied by a mechanical actuator of some type, typically through a linkage that causes crimping jaws to close on the connector.

In the past management of the supply of connectors has been a problem. While vibratory bowl hoppers are well known and effective for feeding items from a random pile into a channel or feed conduit, advancement of so-organized items from the feed conduit to the crimp station of the applicator tool has proven to be difficult. The goal of high production rates suggests that the second-in-line connector in a supply line be instantly ready to take the place of a first-in-line connector after the latter is crimped and withdrawn from the tool. However, that second-in-line connector cannot interfere with the crimping and withdrawal operations on its predecessor. Thus, some kind of separating mechanism between a connector in the ready-to-be-crimped position and its succeeding connector is required. This separating mechanism must then be withdrawn in a coordinated manner with an ejection mechanism to allow the removal of a finished connection and advancement of the succeeding connector to the ready position. The mechanical construction can become rather complex, as demonstrated by the tool of the U.S. Pat. No. 4,489,589.

A further complication arises from the desirability of being able to feed parts to a tool in any orientation, regardless of gravitational effects on the parts in the supply line. That is, in some production lines it is necessary to take the tool to some wires to be connected, rather than vice versa. Such wires may be located above the connector supply so the applicator tool has to be raised upwardly to use it. Connectors then have to be supplied uphill, so to speak, and held in place until installed so they do not fall back down the supply hose toward the hopper.

The present invention addresses these concerns with a supply console that retains all but one connector in a supply chute. One connector only is sent by an air blast through a hose to the applicator tool. The applicator has a body with a passageway connecting an inlet and outlet. The connector is blown all the way through the tool to the crimping station near the outlet. A retainer flexibly extends into the outlet and prevents the connector from being blown all the way through the tool. Nothing else gets in the way of the blown connector.

The applicator has crimping bars or indentors that are movable into the passageway. Once a connector arrives at the crimp station the indentors gently grab the connector, without crimping it, and hold it in place. This prevents the connector from falling back down the supply hose if the applicator happens to be upraised. When a user activates the applicator to finish the crimping procedure the indentors simultaneously crimp the ferrule of the connector and advance it out of the crimping station. Normally the user will then use the wires to pull the connector completely out. The indentors retract, freeing up the passageway for the next connector being blown into the crimp station. If the previous connector is not completely removed from the applicator, the momentum of the following connector being blown into the crimping station will kick its predecessor out of the way.

BRIEF DESCRIPTION OF THE DRAWINGS

FIG. 3 is a section through the handgun of the present invention, shown in the load position wherein it has just received a new connector from the supply console.

FIG. 5 is a section through the handgun of the present invention, shown in the ready position wherein it is holding a connector and waiting for a crimp signal from a user.

FIG. 9 is a side elevation view of the crimp housing.

FIG. 10 is a side elevation view of the crimp housing, this view being rotated 90° from the view of FIG. 9.

FIG. 11 is a top plan view of the crimp housing oriented as in FIG. 10.

FIG. 12 is a bottom plan view of the crimp housing oriented as in FIG. 10.

FIG. 13 is a section taken along line 13—13 of FIG. 9.

FIG. 14 is a section taken along line 14—14 of FIG. 10.

DETAILED DESCRIPTION OF THE INVENTION

Figures 1, 2:
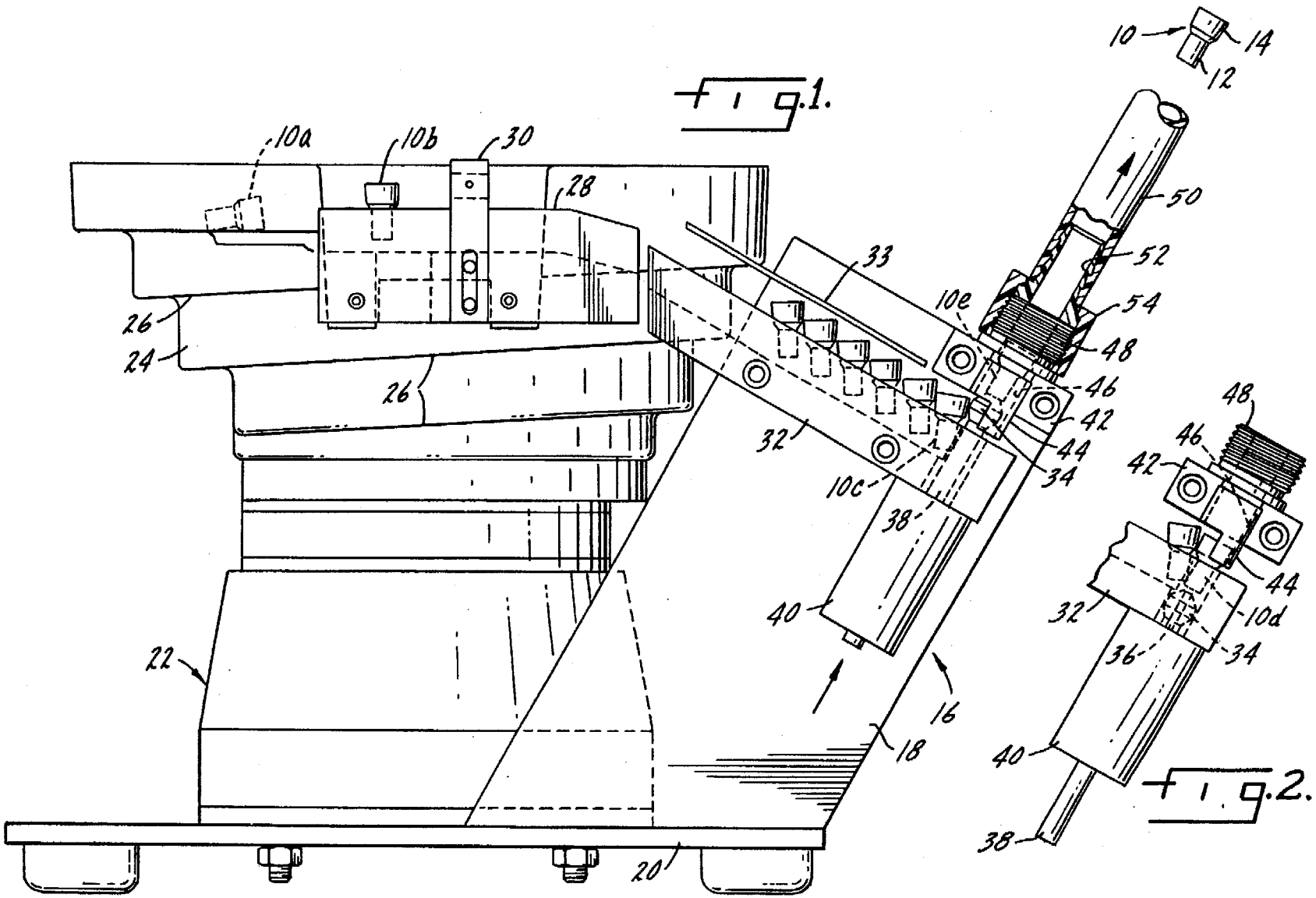
FIG. 1 is a side elevation view of the supply console of the present invention, showing the supply cylinder in the up position.
FIG. 2 is a side elevation view of the supply cylinder and blow chamber, showing the supply cylinder in the retracted or down position.

A pre-insulated crimp connector is shown in FIG. 1 at 10. The connector has a plastic housing including a closed end 12 and an open-ended skirt 14. Although it is not shown, it will be understood that a generally cylindrical metal ferrule is retained in the closed end 12 of the housing. The connector is designed to be crimped onto the exposed conductors of two or more electrical wires. The crimping permanently retains the connector on the wires.

The machine of the present invention automatically installs or crimps connectors 10 onto wires. The machine comprises two major components; a supply console and a handgun. The supply console feeds a random pile of connectors into a chute and propels the connectors one at a time through a hose to the handgun. The handgun receives one connector at a time. It holds the connector in a crimp station and supplies a crimping force which clamps the connector onto the wires when activated by a user.

FIGS. 1 and 2 illustrate the supply console 16. The supply console includes a housing 18 mounted on a base plate 20. The housing encloses a supply of pressurized air and appropriate control valves for directing pressurized air to various actuating cylinders as will be described below. The console further includes a conventional vibratory bowl feeder 22 mounted on the base plate 20. The feeder 22 receives a random pile of connectors which are simply dumped into the interior of the bowl 24. The interior surface of the bowl has a spiral ledge (the external contours of which can be seen at 26) leading from the bottom of the bowl to its top edge. Connectors vibrate up the spiral ledge to the top of the feeder bowl as illustrated by connector 10*a*. The connectors enter a channel 28 which has a pair of spaced rails. The rails are spaced sufficiently to allow the closed end 12 of the housing to fall between the rails while the rails support the skirt 14. This is shown by connector 10*b*. The feeder 22 includes a set of mechanical deflectors and/or air blast separators 30 which knock out of the channel 28 any connectors that are nested inside one another or are otherwise incorrectly oriented in the channel. Any improperly oriented connectors are simply returned to the bottom of the bowl 24.

Connectors vibrate out of the chute 28 into an inclined stationary ramp 32 which is attached to the housing 18. Ramp 32 is similar to chute 28 in that it has two rails separated sufficiently to allow passage of the closed end portions 12 while engaging the skirt portions 14 of the connectors. A cover 33 is provided to protect the connectors as they wait in the queue. The connectors slide down the ramp 32 by gravity until the lead connector in the queue bumps up against a plunger 34 or a stop 44, depending on the plunger position. As can be seen, the plunger has tapered surfaces which allow it to move past the lead connector, shown in position 10*c*, without binding or hanging up on the connector. Plunger 34 has a central air passage shown at 36 in FIG. 2.

The plunger is connected to the end of a piston rod 38. Piston rod 38 moves up and down with a piston (not shown) in an air cylinder 40. The cylinder 40 is bolted to the lower end of the ramp 32. Its piston is spring-loaded to the up or raised position shown in FIG. 1. Air pressure is supplied to the top of the cylinder to get the piston to retract or move downwardly to the position shown in FIG. 2.

The supply console 16 further includes a launching pad 42 which is attached to the housing 18. The launching pad includes a stop 44 which engages the first-in-line connector when the plunger is retracted. The stop also guides the connectors into a central blow chamber 46 formed in the pad 42. The blow chamber is axially aligned with the plunger 34 and rod 38 of cylinder 40. The upper side of the launching pad 42 includes a cylindrical fitting 48 which has a central bore therethrough and threads on its exterior surface. The bore of the fitting is aligned with the axis of the blow chamber 46.

A flexible hose 50 is connected to the launching pad 42. A nipple 52 has a flange at it lower end and a toothed outer surface to grip the end of the hose 50. A nut 54 has a flange which engages the flange on the nipple 52. Threads in the interior of nut 54 engage those of the fitting 48 to connect the hose to the launching pad. Hose 50 extends to a second nipple 56 (FIG. 3) similar to that shown at 52. The hose is press fit onto the nipple 56 which in turn is fastened to the handgun by a threaded nut 58.

The handgun is shown generally at 60. It has a body which includes an elongated handle 62 and a crimp housing 64. Details of the housing 64 will be described below. The handle 62 has internal threads at 66 at its distal or lower end and external threads 68 on a flange portion 70 at the opposite end. The handle has an internal bore 72 with a shoulder 74. The handle further includes a counterbore 76 having an enlarged internal diameter compared to the bore 72.

An actuator shown generally at 78 is attached to the flange 70 of the handle. The actuator has a cup-shaped cylinder 80 with threads at its open end which engage the threads 68 of flange 70. Alternately, cylinder 80 and handle 62 could be assembled with a retaining ring rather than the threads shown. The closed end of the cylinder 80 includes a fitting 82 which is externally threaded to engage the nut 58. Cylinder 80 also has a port 84 for receiving an air pressure line (not shown). Disposed within the cylinder 80 is a piston 86. The piston is sealed against the internal surface of cylinder 80 by an O-ring 88. The piston has a central opening through which an elongated feed tube 90 passes. The feed tube is fixed to the piston 86. The tube has a central duct or bore centered on the axis 140 of the handgun. O-rings 92 seal the piston and cylinder against the feed tube 90. The piston 86 is biased toward the top of the cylinder 80 as shown in FIG. 3 by a return spring 94. The return spring wraps around the feed tube 90 and bottoms against the shoulder 74 in the handle 62.

The lower end of the feed tube 90 is threaded to a yoke 96. The yoke is a cylindrical member having a diameter which allows most of the yoke to slide within the bore 72 of the handle. The yoke includes an enlargement 98 which fits within the counterbore 76 but engages the shoulder formed at the junction of the counterbore and bore. The enlargement 98 mounts a pair of pivot pins 100. A pair of indentors 102 have their inner ends pivotally mounted on pins 100. The outer or lower ends of the indentors have a tapered nose portion 104. The nose of each indentor is engageable with a roller 106 mounted on a pin 108 which is connected to the crimp housing 64. The indentors 102 are biased away from one another by a single C-shaped spring 110. The free ends of the spring 110 are fitted in holes in the indentors 102 while the body portion of the spring surrounds the exterior of the feed tube 90.

Figure 4:
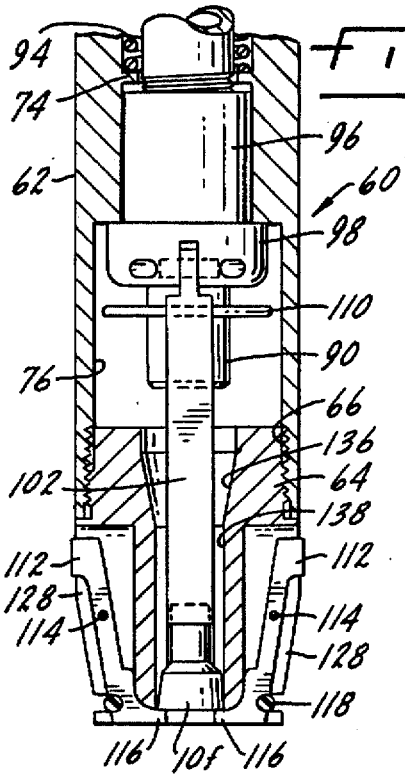
FIG. 4 is a section through the handgun, also shown in the load position, the section being rotated 90° from the view of FIG. 3.

Looking at FIG. 4, a pair of retainers 112 are pivotally mounted on pins 114. Pins 114 are installed in the crimp housing 64. The outer ends of the retainers 112 have fingers 116 which extend into the outlet passage of the crimp housing 64. The fingers are biased toward one another by an O-ring 118. The fingers 116 define a crimp station wherein a crimp connector is held prior to installation on the wires.

Looking now at FIGS. 9–14, details of the crimp housing 64 are shown. The housing is a generally cylindrical member having a central passage therethrough. The housing is divided into two halves 120 by a pair of indentor channels 122. The indentors 102 reside in the channels 122. The halves 120 are joined by webs 124 near the bottom of the housing. Threads 126 are disposed near the top of each half 120 for engagement with the threads 66 of the handle 62.

Elongated grooves or pockets 128 are disposed on the exterior surface of each half 120. The grooves 128 are disposed at 90° to the channels 122. Retainers 112 fit in the grooves, held by pins 114. Holes 130 are drilled to receive the pins 114 on which the retainers 112 are mounted. Similarly, there are bores 132 which receive the pins 108 and rollers 106. The lower end of each housing half 120 has a groove 134 which receives the O-ring 118. There is a central passage through the housing 64. It includes a tapered funnel portion 136 which joins a main portion 138 that extends through the remainder of the housing, including in between the webs 124. These are aligned with the duct through feed tube 90 to define a passageway fully through the handgun.

The use, operation and function of the invention are as follows. At the supply console 16 the connectors are queued up in the ramp 32. Whenever the blow chamber 46 is empty a control valve in the housing 18 applies pressurized air to the top end of the cylinder 40, overcoming the return spring force and retracting the piston rod 38 and with it the plunger 34. With the plunger retracted to the position of FIG. 2, a connector 10*d* falls by gravity against the stop 44. Then the control valve removes the air pressure from cylinder 40 allowing its return spring to push the rod 38 and plunger 34 back up to the position shown in FIG. 1. The raising of plunger 34 advances connector 10*d* to the position shown in outline form at 10*e* within the blow chamber 46 of launching pad 42. When the user activates a switch in the handgun the crimp cycle of the handgun is performed, ending with a blast or pulse of pressurized air being introduced into the blow chamber through the port 36 in the plunger 34. It will be noted that loading the first connector into an empty handgun will require a crimp cycle being performed with no connector in place for crimping but there is no harm in doing so.

The connector is propelled by the air blast through the hose 50 and into the feed tube 90 of the handgun. The connector continues out the bottom end of the feed tube 90, through the funnel portion 136 of the passageway in housing 64 and into the passageway 138. The fingers 116 of the closed retainers 112 arrest movement of the connector in the crimping station as shown at 10*f* in FIGS. 3 and 4.

When the handgun 60 is ready for loading a connector into the crimp station, the control valve in the console housing 18 exhausts air pressure from the cylinder 80 through port 84. This allows the spring 94 to push the piston 86 to the raised or retracted position shown in FIGS. 3 and 4. When the piston retracts it carries yoke 96 with it to the upward position, thereby pulling the indentors 102 upwardly so only the tapered nose 104 of the indentors remains in contact with the rollers. The spring 110 urges the indentors out of the passageway 138 to the load position of FIG. 3. The O-ring 118 biases the fingers 116 of retainers 112 inwardly so that the fingers are disposed within the path of the passageway 138. In this load position, the retainers are the only obstruction in the passageway but as such they will intercept a connector coming through the passageway.

Figure 6:
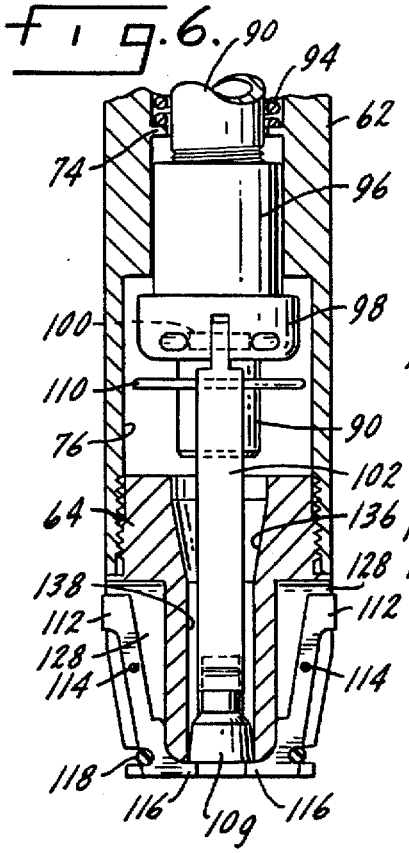
FIG. 6 is a section through the handgun, also shown in the ready position, the section being rotated 90° from the view of FIG. 5.

When a new connector arrives at the crimp station the control valve causes low pressure air to enter cylinder 80 through port 84, advancing the piston 86 slightly as shown in FIGS. 5 and 6. Advancement of the piston 86, of course, carries with it the feed tube 90, the yoke 96 and the indentors 102. The nose 104 of the indentors hits the rollers 106, causing the nose portions to move toward the axis 140 of the handgun and into contact with the connector 10*g*. The pressure in the cylinder 80 at this point is not great enough to advance the piston and indentors beyond their positions shown in FIGS. 5 and 6 so the connector 10*g* is simply held in position ready to be crimped. Low pressure air is maintained in the cylinder until a user is ready to apply the connector to some wires.

Figure 7:
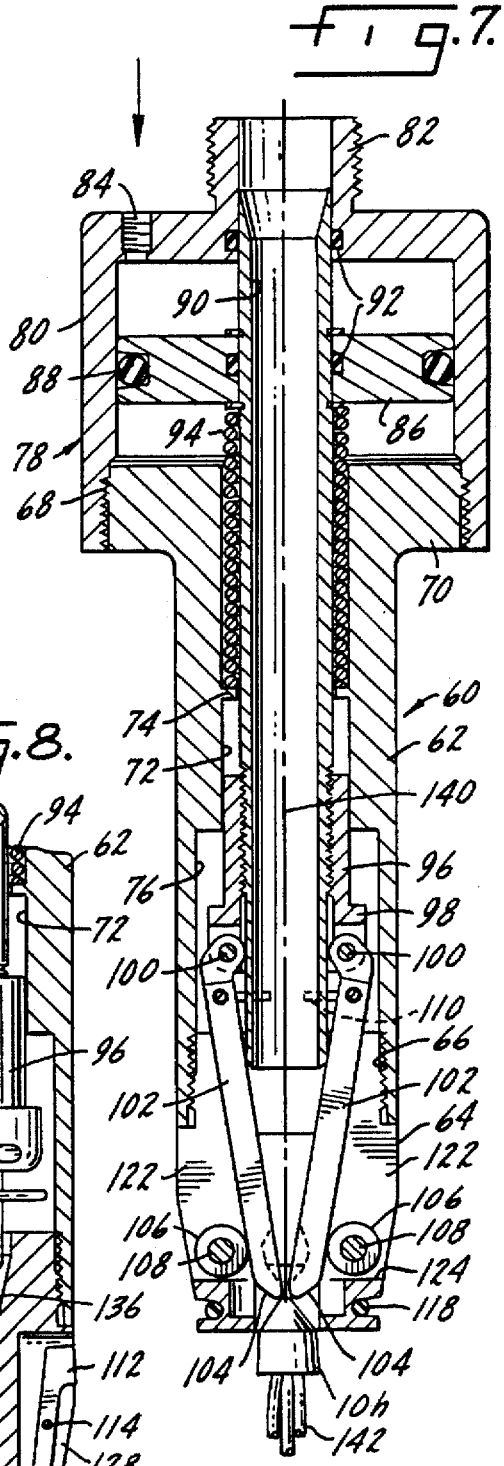
FIG. 7 is a section through the handgun of the present invention, shown in the crimp position wherein it has applied a crimping force to the connector and advanced it beyond a retainer.
Figure 8:
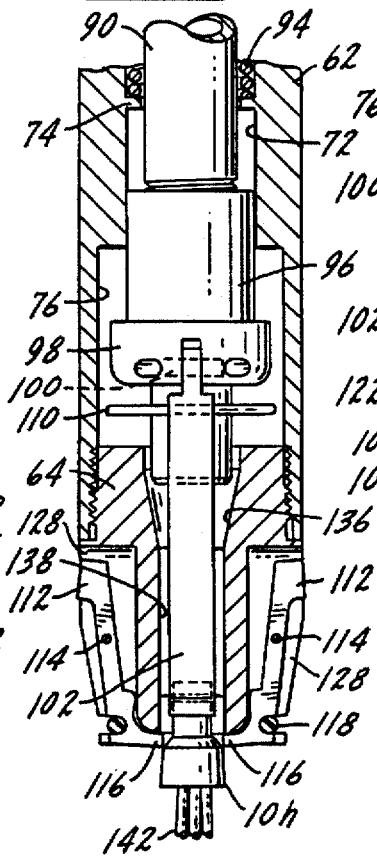
FIG. 8 is a section through the handgun, also shown in the crimp position, the section being rotated 90° from the view of FIG. 7.

Once the wires 142 (FIGS. 7 and 8) are placed by a user through the open end of the connector skirt at the crimping station, the user will activate a switch (not shown) to cause high pressure air to enter the cylinder 80. This advances the piston toward the bottom of the handgun and thereby carries the feed tube, yoke and indentors to the position shown in FIGS. 7 and 8. The rollers 106 force the indentors 102 inwardly toward each other while at the same time advancing toward the bottom of the tool. This action forces the indentors to crimp the closed end portion 12 of the connector shown at 10*h*. The forward or downward advance of the indentors also pushes the crimped connector 10*h* past the fingers 116 of the retainers 112. The flexible O-ring 108 allows the retainers to swivel outwardly about pins 114 and permit passage of the crimped connector.

Typically the user will at this point pull either the handgun or the wires to eject the connector out of the tool. If this does not happen, then the resetting of the tool will eject the finished connector in the following manner. Once the crimp movement has been completed, the control valve removes the high pressure air from cylinder 80 allowing spring 94 to return the piston 86 to its retracted or raised position. This carries the feed tube, yoke and indentors back to the load position of FIG. 3. Thus, the indentors 102 are returned to a position outside the path of the passageway 136 and 138. At this time, another pulse of air is supplied to the launching pad causing a next connector to be propelled through the hose 50 and through the feed tube down into the crimp housing 64. The momentum of the arriving successor connector will push a prior finished connector out the end of the tool.

It can be seen that a simplified handgun structure is provided wherein a single connector is fed one at a time from the supply console all the way to the crimp station. There is no subsequent handling required to advance the part to a crimping position; it arrives there in a single step. Further, the supply of successor connectors is held back at the console so the handgun need make no provision for restraining successor connectors waiting in their queue. The handgun has a passageway which is uninterrupted all the way to the crimp station defined by the retainers 112. Another advantage of the present invention is the indentors grab the part in the crimp station and hold it with a non-crimping force until such time as a user is ready to install the connector on some wires. Thus, the handgun can be oriented in any position and a connector at the crimp station will neither fall out of the tool nor fall back down into the feed tube and hose.

While a preferred form of the invention has been shown and described, it will be realized that alterations and modifications may be made thereto without departing from the scope of the following claims.

I claim:

1. A crimp connector applicator, comprising:

a handgun having a body with a passageway through it, the passageway defining an axis and having an inlet at one end and an outlet at the other end, the cross-section and configuration of the passageway being such that a crimp connector can be propelled by a single pulse of air pressure into the inlet and through the passageway to the outlet;

a retainer pivotally attached to the handgun near the outlet and biased into the outlet such that the retainer will prevent a crimp connector propelled by air pressure from exiting the passageway, the retainer thereby defining a crimp station near said other end of the passageway;

at least two indentors mounted in the handgun and movable toward and away from said axis; and actuator means mounted in the handgun for moving the indentors between a load position, wherein the indentors are outside of the passageway such that the passageway is unobstructed from the inlet to the retainer, a ready position, wherein the indentors move into the passageway and engage a connector located at the crimp station with a non-crimping force, and a crimp position, wherein the indentors engage a connector located at the crimp station, crimp said connector and advance it at least partially past the retainer.

2. The applicator of claim 1 wherein the passageway is straight.

3. The applicator of claim 1 wherein the actuator comprises an air cylinder, a piston axially reciprocable in the air cylinder, and a feed tube attached to the piston for axial movement therewith, the feed tube defining a portion of the passageway between the inlet and outlet.

4. The applicator of claim 3 wherein the indentors are pivotally connected to the feed tube and further comprising springs biasing the indentors away from the axis toward the load position.

5. The applicator of claim 3 wherein each indentor has a tapered nose portion and further comprising rollers mounted in the body and engageable with the nose portions of the indentors when the indentors move with the feed tube toward the outlet of the passageway, the rollers causing the indentors to pivot toward the axis.

6. The applicator of claim 3 further comprising a yoke affixed to the feed tube, the indentors being pivotally connected to the yoke.

7. The applicator of claim 1 wherein the body comprises a crimp housing having at least one groove in which the retainer fits and a pair of channels, one indentor residing in each channel.

8. The applicator of claim 1 wherein the body comprises a crimp housing connected to an elongated, hollow handle.

9. In a machine for installing crimp connectors of the type having a connector supply for feeding individual crimp connectors one at a time through a flexible hose to an applicator, the hose being connected to an inlet of the applicator, the applicator having a crimp station near an outlet for discharging the connectors and a passageway connecting the inlet and outlet, and crimping means in the applicator for crimping connectors at said crimp station onto wires, an improved method of installing the connectors comprising the steps of:

propelling a single connector by means of a single pulse of air pressure from the supply, through the hose, into the inlet and through the passageway;

arresting movement of the propelled connector at the crimp station;

engaging a connector at the crimp station with a crimping tool to hold the connector at the crimp station until a user activates the applicator; and upon activation of the applicator by a user, crimping the connector onto wires while advancing the connector from the crimp station to the outlet.

* * * * *